US008794629B1

(12) United States Patent
Humphreys, Jr.

(10) Patent No.: US 8,794,629 B1
(45) Date of Patent: Aug. 5, 2014

(54) METHOD AND APPARATUS FOR POKER BAG TOSS GAME

(76) Inventor: Richard R Humphreys, Jr., Delaware, OH (US)

( * ) Notice: Subject to any disclaimer, the term of this patent is extended or adjusted under 35 U.S.C. 154(b) by 217 days.

(21) Appl. No.: 12/923,292

(22) Filed: Sep. 14, 2010

Related U.S. Application Data

(60) Provisional application No. 61/272,334, filed on Sep. 14, 2009.

(51) Int. Cl.
*A63B 63/00* (2006.01)

(52) U.S. Cl.
USPC ..... 273/400

(58) Field of Classification Search
USPC ..... 273/394, 398–402, 407, 121 B, 123 R; 473/594
See application file for complete search history.

(56) References Cited

U.S. PATENT DOCUMENTS

| | | | | | |
|---|---|---|---|---|---|
| 175,254 | A * | 3/1876 | Oberly | 273/394 |
| 827,626 | A * | 7/1906 | Gillet | 273/402 |
| 848,711 | A * | 4/1907 | Weaver | 273/394 |
| 1,072,954 | A * | 9/1913 | Junn | 273/394 |
| 1,279,654 | A * | 9/1918 | Charlesworth | 273/399 |
| 1,918,094 | A * | 7/1933 | Geekas | 273/354 |
| 1,996,986 | A * | 4/1935 | Weinberg | 273/400 |
| 2,021,989 | A * | 11/1935 | De Master | 273/401 |
| 2,146,636 | A * | 2/1939 | Lipchow | 273/317.6 |
| 3,429,574 | A * | 2/1969 | Williams | 273/123 R |
| 3,575,415 | A * | 4/1971 | Fulp et al. | 273/400 |
| 5,112,048 | A * | 5/1992 | Kienle | 273/121 R |
| 7,900,928 | B2 * | 3/2011 | Held et al. | 273/402 |
| 2008/0042360 | A1 | 2/2008 | Veikley | |
| 2010/0194047 | A1 * | 8/2010 | Sauerwine | 273/400 |

* cited by examiner

*Primary Examiner* — Mark Graham
(74) *Attorney, Agent, or Firm* — Vorys, Sater, Seymour and Pease LLP; William H. Oldach, III; William L. Klima

(57) ABSTRACT

A game board is provided having a playing surface and a support structure so that the board is angled at approximately 75 degrees to the ground. The board has a bottom wall and a plurality of side walls extending therefrom defining one or more scoring areas. In a preferred embodiment the scoring areas correspond to playing card values, a ledge is provided as a wild card, and players toss five bags per round to build poker hands.

11 Claims, 4 Drawing Sheets

METHOD AND APPARATUS FOR POKER BAG TOSS GAME

RELATED APPLICATION

This application is a non-provisional application based upon Provisional Application Ser. No. 61/272,334, filed Sep. 14, 2009, priority to which is hereby claimed and which is incorporated herein by reference.

BACKGROUND

1. Field of the Invention

This invention relates to a method and apparatus for playing a bag toss game having elements evocative of the game of poker.

2. Description of Related Art

Bag toss games commonly referred to generically as "cornhole" are well known throughout the United States, and in particular, in the Midwestern section of the United States. In a typical cornhole game, a board angled from between 20 and 30 degrees to the ground and having a centered hole toward its top is set up a predetermined distance from two or more competitors, who take turns tossing corn-filled bags or similarly-sized flimsy but weighted objects toward the board. The goal of the game is to cause the bags to 1) pass through the hole or 2) come to rest on the board, in order to score points. One way to do this is to toss the bag with an arc such that it passes directly through the hole without significantly striking the board. More commonly, however, a skilled tosser will attempt to toss the bag with somewhat less arc toward a lower area of the board, causing the flimsy bag to flatten against the board and then ride up the gentle slope toward the hole, so that a toss that does not go through the hole will nevertheless come to rest on the board and score points. A toss hitting the upper area of the board but missing the hole, however, will typically slide up and off the board, scoring no points.

Variations on the cornhole game are not uncommon. One attempt at developing a cornhole game suggestive of aspects of poker can be found in U.S. Patent Application Publication No. 20080042360 to Veikley. In that game, a typical cornhole board has a plurality of holes representing playing card values. For example, a board with five holes could represent the playing card values 10-J-Q-K-A, and a board with seven such holes could add the 8 and 9 values. In each round, a competitor would try to build the best possible poker hands. If five bags are tossed, for example, a competitor could conceivably score five aces, or build a five-card straight. Of course, bags not landing on the board or not going through a hole would not contribute to the competitor's score.

The Veikley approach, while adding a degree of variety to the typical cornhole game, nevertheless suffers from several disadvantages. Most significantly, any given toss going through a hole is no longer visible to either competitor during the round in progress. Because the game of poker involves building hands based upon what cards have previously been obtained, this renders it more difficult for the competitor to remember what previous cards have been scored and which holes it would be more advantageous to aim at. Also, in a typical cornhole game with a single hole, it is relatively simple for the competitors to look under the board after a round to count how many bags each competitor got through the hole. In the Veikley game, however, with its plurality of holes, such an inspection may not clearly reveal which bags went through which holes. Where, as noted above, memories are unclear as to which cards each competitor scored, disputes may arise. When these memory lapses lead to disputes fueled by beverages such as may be provided in the festive environments in which cornhole games are often played, a dissatisfying experience may be had.

Another disadvantage of the Veikley approach is that it uses a standard sized cornhole board at a standard cornhole angle, such as 20 to 30 degrees. This means that a number of tosses that do not go through a hole will come to rest on the board without scoring. This both reduces the possibilities for building a poker hand and obstructs other tosses from going through holes, reducing the possibilities even further. Because poker is a game in which "big hands" make for excitement, use of the typical cornhole equipment is less than ideal.

Accordingly, it is an object of the present invention to provide a variety cornhole-type game, suggestive of elements of card games such as poker, in which the results of all tosses by each competitor in a given round remain visible to all competitors.

Additionally, it is an object of the present invention to provide a variety cornhole-type game with equipment structured such that a higher percentage of tosses will be scoring tosses than in regulation cornhole.

It is a further object of the present invention to provide a variety cornhole-type game in which a high-risk, high-reward target is presented.

It is a still further object of the present invention to provide a variety cornhole-type game appropriate for educational settings using mathematical concepts.

SUMMARY OF THE INVENTION

The foregoing objects are achieved in the present invention in which a large board is provided at one end of a game-playing area. The board is provided with two or more struts so that the board can be set up in the manner of an easel, so that the angle of the front of the board to the ground is approximately 75 degrees.

The bottom of the front of the board has a plurality of walled areas, open at the top, representing playing card values such that a corn-filled bag or similar flimsy but weighted object hitting the board will flatten and slide down into one of the walled areas.

In a preferred embodiment of the invention, a ledge representing a Wild Card is situated about midway up the center of the board. As in regular poker, a chief purpose of the wild-card ledge is to enhance the possibility of scoring higher-valued hands. Another purpose of the ledge can be to make other high-scoring values harder to hit, or to increase the possibility that a toss aimed at the ledge will land in a lower-valued area.

DESCRIPTION OF THE PREFERRED EMBODIMENT

Figure 1:
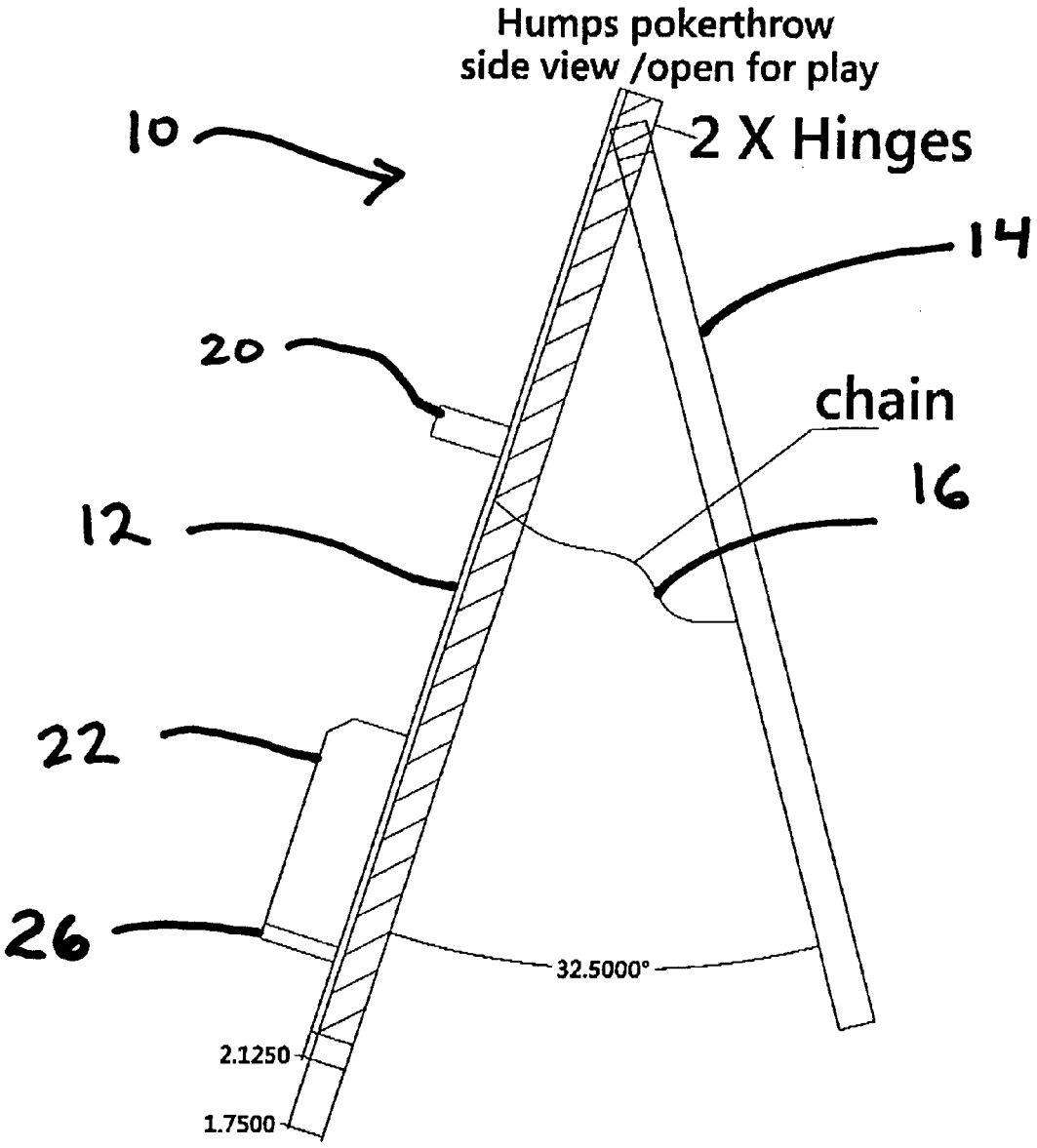
FIG. 1 shows a side view of a game board of the present invention in an extended position.
Figure 2:
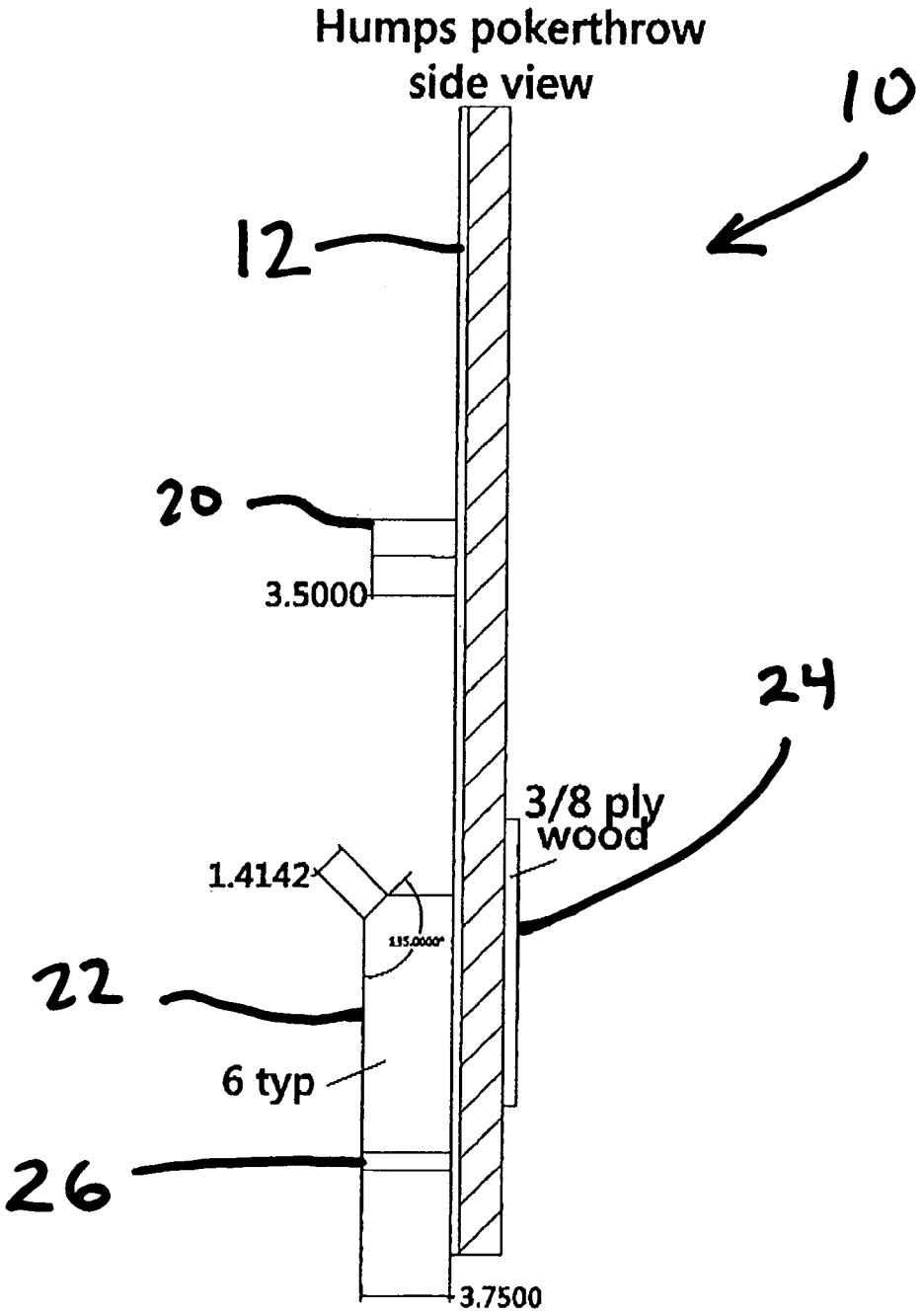
FIG. 2 shows a side view of the game board in a retracted position.

The variety cornhole-type game suggestive of poker will now be described in greater detail. As seen in FIGS. 1 and 2, the game apparatus 10 comprises a front board 12 and two rear struts 14. The board can be made out of a simple treated plywood or similar material. The board can be sized similar to a regulation corn-hole board, or can be sized larger to accommodate a sizeable number of bags accumulating in walled areas as discussed below. As will be seen throughout the figures herein, specific dimensions are given that represent the most preferred present embodiment of the invention. The dimensions, of course, are not intended as limitations on the scope of any claims that may be made.

The struts 14 can be made out of 2×4's or similar material. The struts are joined to the left and right of the top of the front board 12 through two hinges (not shown) or other equivalent mechanisms known in the art so that the struts can retract against the board 12 for compact storage and transport. The struts 14 can be joined to board 12 alternatively at a lower height on board 12. As seen in FIG. 1, a chain 16 can be connected between the middle of the front board 12 and the middle of one or both of the struts 14. The chain 16 is sized so as to become taut when the struts 14 are extended a suitable amount, which would be when the angle between the board 12 and the struts 14 is approximately 32.5 degrees, as shown in FIG. 1. Alternatively, a hinged member affixed rotatably to the front board and the struts can be used for this purpose.

As shown in FIG. 1, when the apparatus is extended, the apparatus 10 will sit on a surface such as the ground so that the front board 12 is angled at approximately 75 degrees to the ground, in contrast to the 20 to 30 degrees of a regulation cornhole board.

Also as seen in FIGS. 1 and 2, the front board 12 comprises a ledge 20, a plurality of side walls 22 and a bottom wall 26 which jut out from the front board 12 for purposes of game play as discussed below. The walls 22 and 26 and ledge 20 can be made from any suitable material, such as a 1×4. The walls 22 and 26 and ledge 20 preferably jut out about 3.5 inches from the front board 12. The top edge of the walls 22 and 26 may optionally be beveled.

Figure 3:
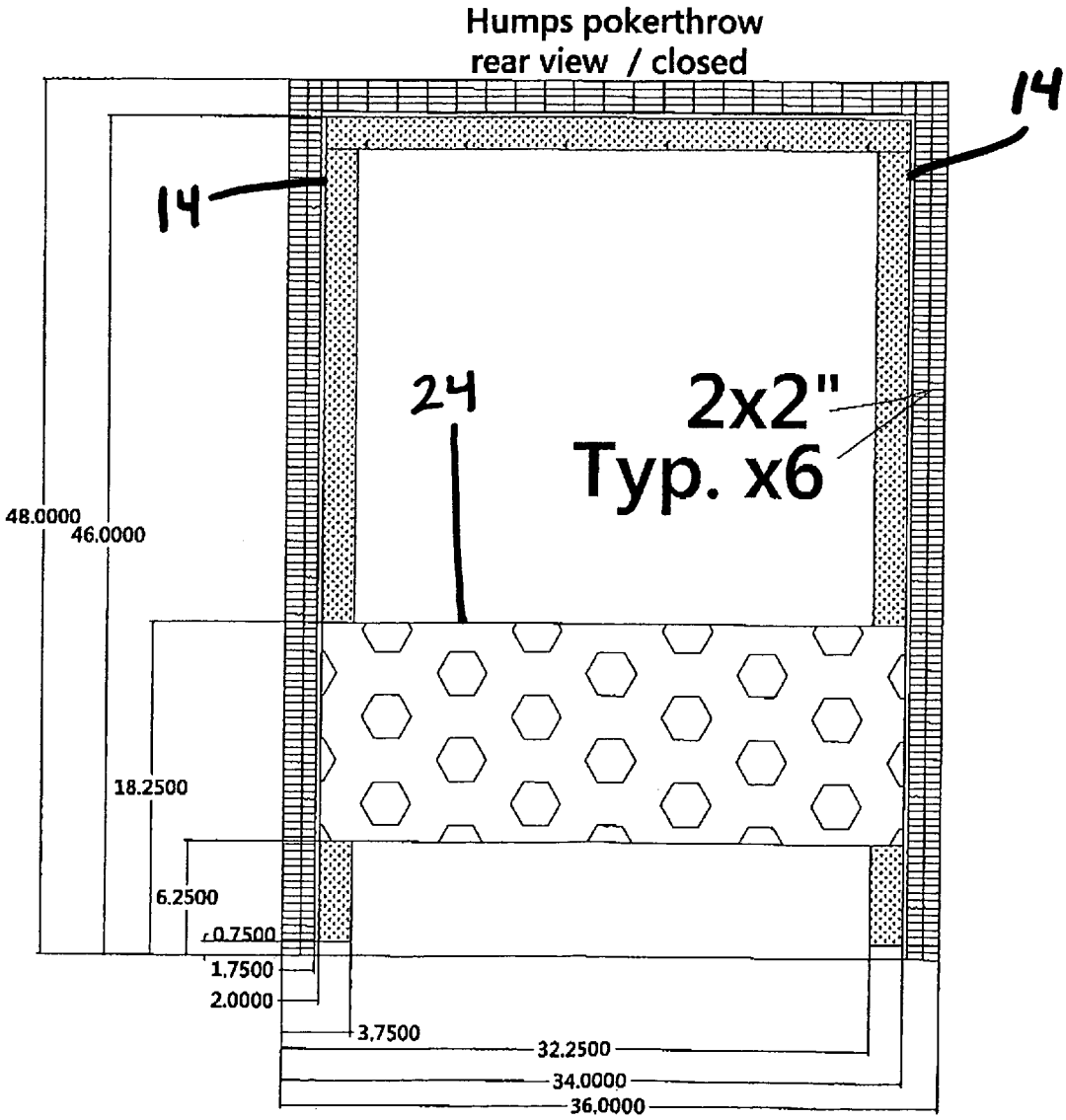
FIG. 3 shows a rear view of the game board.

As seen in the rear view of FIG. 3, the lower ends of rear struts 14 are preferably joined to a supporting member 24, which may be made from ⅜-inch plywood or other suitable material. The member 24 is approximately 1 foot in height and its bottom is situated about 6 to 6.5 inches above the ground.

Figure 4:
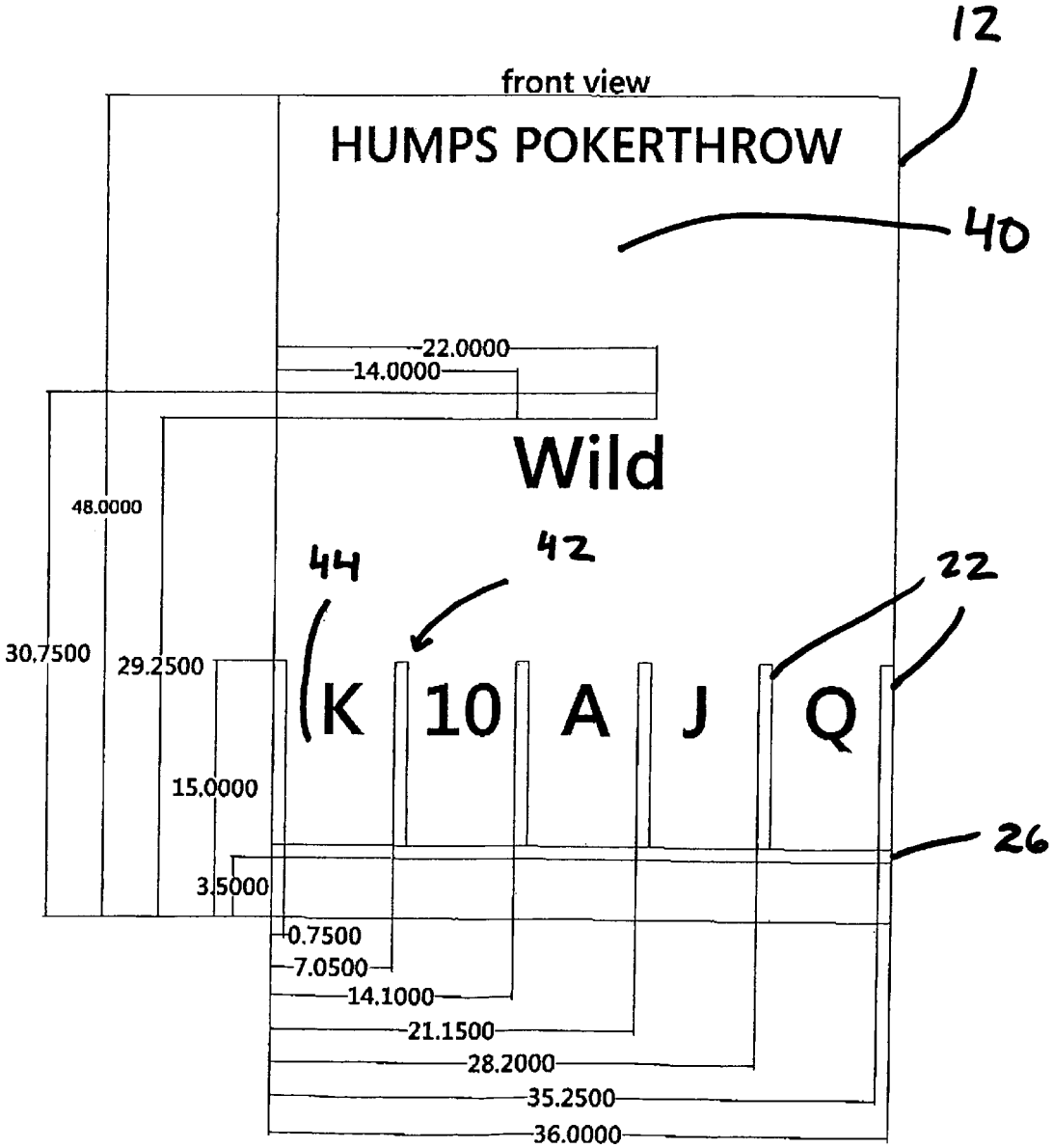
FIG. 4 shows a front view of the game board.

Turning now to FIG. 4, the front of the game board, and the rules for the game, will be explained in further detail. The front of the game board defines a playing surface 40. In addition to providing legends describing the values of the various areas of the surface, the surface 40 may also preferably comprise art or other poker-related graphics designed to increase the attractiveness of the game equipment and generate excitement about the play of the game.

As can be seen, the walls 22 and 26 are constructed to form a structure that could be referred to as an upside down "rake" 42. The plurality of areas 44 between the walls 22 of the rake 42 correspond to different playing card values. The bottom of the rake 42 (bottom wall 26) is preferably about 3.5 inches above the ground, and the top of the rake 42 is preferably about 15 inches off the ground. Each area 44 is about 7 inches in width. The plurality of areas 44 are open faced and open at an upper end.

In the preferred embodiment shown, there are five areas 44, each representing a different playing card, in this case 10-J-Q-K-A. As the most valuable card, the A is located in the central area, with the less valuable 10 and J next to it, and the more valuable Q and K on the outer areas. The areas are thus strategically placed so that a toss aimed at the A may hit the less valuable areas. In one embodiment of the game, a bag tossed early in the round could be dislodged or ejected from the rake by a bag tossed later in the round. Only those bags completely within one of the areas would count for scoring purposes. Alternatively, a clear plastic shield (not shown) could be secured over the rake 42, so that bags could not be dislodged by later tosses, but so that the visibility of the bags would be maintained.

In addition, in the preferred embodiment, the board 12 includes a Wild Card ledge 20 situated about 29 inches off the ground and centered over the A area. The primary purpose of the Wild Card ledge 20 is to enhance the probability of higher scoring hands, thus adding to the general excitement of game play. However, it is an inherent feature of the ledge 20 that any area 44 over which it is positioned would become marginally more difficult to land a bag in. In this embodiment, the ledge is positioned above the A area thus making that area somewhat harder to slide a bag down into. The ledge also can be sized such that the ends of the ledge are positioned above two lower-value walled areas, thus increasing the penalty for attempting to reach the ledge but missing. In the embodiment shown, the ledge is centered in the board and is about 8 inches in width, so that any bag landing partially on the ledge and sliding off will most likely fall into the 10 or J areas, which are the two lowest ranks shown.

The rules of the game are that each competitor takes turns throwing one bag until each competitor has thrown five bags. The rank of hands is similar to that in poker, with the exception that, because it is equally as difficult to land one bag in each of five areas as it would be to land all five bags in one area, a straight is equally as likely (or unlikely) as five-of-a kind, and both are the highest ranked hands. The full ranking and scoring of hands according to the currently most preferred embodiment is as follows, with the first listed of any two hands having the same value prevailing over the other on a tie-breaker:

| | |
|---|---|
| Five-of-a-Kind | 6 |
| Straight | 6 |
| Four-of-a-Kind | 5 |
| Full House | 5 |
| Three-of-a-Kind | 4 |
| Two Pair | 3 |
| One Pair | 2 |
| High Card | 1 |

As any card missing the board and not landing in an area (or being dislodged from an area) would not count toward the competitor's score, it is possible that a score would be based on fewer than five bags. Under one embodiment, a rule can be in place that any bag partially resting on the top of a rake wall does not count for scoring.

In the simplest preferred embodiment shown, there are no suits, so that a flush or straight (royal) flush is not possible. However, one alternative embodiment could include four rows of rakes, with each row representing a playing card suit. As a further alternative, the cards could be arranged as five rakes of four areas each, with each rake representing a card value. And of course, the number of areas in each rake could be varied to provide for additional card values. As the number of walled areas increases, the need for and feasibility of the ledge would decrease.

Because the construction of the game apparatus used herein differs in certain key respects from the typical cornhole game, certain advantages become apparent. In particular, because the board is angled at about 75 degrees to the ground, a successful toss will land above the rake (as opposed to below the hole in typical cornhole) and will slide down into a walled area, where it will remain visible to both competitors, aiding the competitors in their strategic decision of which area to aim at. Another advantage is that determining which competitor's bags landed in which areas after a round may be less open to dispute than in regular cornhole or the Veikley game.

NUMBERTHROW

In another preferred embodiment of the subject invention, rather than using playing card values in the "rake" area, numerical values could be provided for use with a game involving addition or subtraction, and the ledge could be used to change from addition or subtraction to multiplication or division, respectively. Such a game could be used for educational purposes for school-aged children, thus increasing the marketability of the invention to audiences for whom the poker embodiment might be deemed inappropriate. For purposes of reference herein this category of game is referred to as "Numberthrow", whereas the first embodiment is called "Pokerthrow."

For example, in one embodiment of Numberthrow, the values 1 through 5 could be provided in the rake areas, with a normal operation of addition. Thus, the player would score the sum of the values of his or her bag tosses landing in the rake. Other possibilities for the rake area numbers, such as 6 through 10; 1, 3, 5, 7 and 9; or many others are conceivable, as are more or fewer rake areas. A final target number would also be provided, for example, 50 or 100. In such an embodiment, the wild card ledge could be used to change the mathematical operation from addition to multiplication for the next bag tossed. For example, if a player's tosses landed as follows: 4, 2, 3, ledge, 3, the player would score (4+3+2) *3=27 points.

The game can be made more challenging by requiring that the target number be hit exactly. Thus, in a game to 100, if one player is on 91 points, and his next tosses are 1, 3 and 4, then he will have 99 points and only another 1 will reach exactly 100 points; depending on the rule, any other value could either not count, reset the player's score to the beginning of the round, or reset the player's score to zero.

Having now described a few embodiments of the present invention, it should be apparent to those skilled in the art that the foregoing is merely illustrative and not limiting, having been presented by way of example only. Numerous modifications and other embodiments are within the scope of the invention and any equivalent thereto. It can be appreciated that variations to the present invention would be readily apparent to those skilled in the art, and the present invention is intended to include those alternatives. Further, since numerous modifications will readily occur to those skilled in the art, it is not desired to limit the invention to the exact construction and operation illustrated and described, and accordingly, all suitable modifications and equivalents may be resorted to as falling within the scope of the invention.

What is claimed is:

1. A method for playing a bag toss game comprising:

providing a game board comprising an upper end and a lower end, the game board comprising:

a lower wall affixed to the game board and oriented horizontally relative to the game board, the lower wall extending outwardly from the game board;

two side walls affixed to the game board and oriented vertically relative to the game board, the side walls being located at opposite ends of the lower wall, the two side walls extending outwardly from the game board;

one or more internal walls affixed to the game board and extending upwardly from the lower wall a predetermined distance, the one or more internal walls extending outwardly from the game board, the side walls and the one or more internal walls defining a plurality of scoring areas on the game board, the scoring areas each being opened faced and open at an upper end of each scoring area, and said each scoring area configured to represent a playing card value; and an outwardly extending ledge affixed to the game board and oriented horizontal relative to the game board, the ledge being located above the one or more scoring areas, the ledge configured to represent a wild card; and throwing a plurality of flimsy weighted objects toward said board, a game-related result from each throw being a function of whether or not the object comes to rest in a scoring area, wherein each of the scoring areas is of sufficient size to accommodate a plurality of the flimsy weighted objects.

2. The method according to claim 1, wherein said ledge is situated between the upper end of said two side walls and said upper end of said board.

3. The method according to claim 1, wherein said ledge corresponds to a mathematical operation.

4. The method according to claim 1, wherein said playing card values are ten, jack, queen, king and ace.

5. The method according to claim 4, wherein a player throws five objects per turn.

6. The method according to claim 5, wherein the result of a player's five throws correspond to a poker hand.

7. The method according to claim 1, wherein said scoring areas correspond to numerical values.

8. The method according to claim 1, wherein said ledge is situated above said one or more scoring areas having a higher assigned value than others of said scoring areas.

9. The method according to claim 1, wherein the ledge is centered on the game board and positioned above a center scoring area.

10. The method according to claim 9, wherein ends of the ledge are positioned above two lower-valued scoring areas, whereby this arrangement increases a penalty for attempting to reach the center scoring area.

11. The method according to claim 10, wherein the center scoring area represents an ace playing card.

* * * * *